US008546711B2

(12) United States Patent
Spengler et al.

(10) Patent No.: US 8,546,711 B2
(45) Date of Patent: Oct. 1, 2013

(54) PNEUMATIC SWITCH

(75) Inventors: Stefan Spengler, Siblingen (CH); Stephan Koll, Schaffhausen (CH); Patrick Kemna, Schaffhausen (CH); Liebmer Trauschein, Thayngen (CH)

(73) Assignee: Bircher Reglomat AG, Beringen (CH)

( * ) Notice: Subject to any disclaimer, the term of this patent is extended or adjusted under 35 U.S.C. 154(b) by 325 days.

(21) Appl. No.: 12/855,969

(22) Filed: Aug. 13, 2010

(65) Prior Publication Data

US 2011/0042198 A1 Feb. 24, 2011

(30) Foreign Application Priority Data

Aug. 18, 2009 (DE) ..... 10 2009 037 798

(51) Int. Cl.
*H01H 35/24* (2006.01)

(52) U.S. Cl.
USPC ..... 200/83 S; 200/83 R

(58) Field of Classification Search
USPC ..... 200/83 R, 83 B, 83 J, 83 P, 83 S, 200/83 SA
See application file for complete search history.

(56) References Cited

U.S. PATENT DOCUMENTS 5,336,858 A * 8/1994 Kaigler ..... 200/83 R
5,461,208 A * 10/1995 McKenna ..... 200/83 J

* cited by examiner

*Primary Examiner* — Amy Cohen Johnson
*Assistant Examiner* — Marina Fishman
(74) *Attorney, Agent, or Firm* — Bachman & LaPointe, P.C.

(57) ABSTRACT

A pneumatic switch (1) having a diaphragm (3) and a switching mechanism operationally connected to the diaphragm (3), the switching mechanism comprises a prestressing element which can be adjusted.

9 Claims, 4 Drawing Sheets

PNEUMATIC SWITCH

BACKGROUND OF THE INVENTION

The invention relates to a pneumatic switch and a production method for producing a pneumatic switch.

The prior art discloses pneumatic switches which have a diaphragm which delimits a pressure space. Upon an increase in the pressure in the pressure space, for example owing to a pressure wave fed to the diaphragm, the diaphragm activates a pressure plate which can, in turn, close or open an electrical circuit via a sliding contact.

In the case of pneumatic switches known from the prior art, it is possible to set a response threshold of the pressure at the diaphragm by displacing a fixed contact. If, for example, the fixed contact is arranged further removed from the diaphragm, a higher pressure is required to activate the diaphragm.

A disadvantage of the pneumatic switches known from the prior art is that, on the one hand, they have a low response sensitivity while, furthermore, sliding contacts are disadvantageous since they have intermediate positions in which it is possible in some circumstances to have only partial contact.

It is an object of the invention to specify a pneumatic switch and a production method for a pneumatic switch, with which the disadvantages from the prior art can be removed. In particular, it is an object of the invention to specify a pneumatic switch having a high sensitivity, having a response sensitivity which can be set more easily, or having defined switching points. It is preferably also an object of the invention to specify a switch and a production method for a switch which can be converted from an opening to a closing switch, or vice versa, or can at least be differently configured during production with little outlay such that it is activated open or activated closed.

SUMMARY OF THE INVENTION

The object is achieved with the aid of a pneumatic switch and of a production method for a pneumatic switch.

The invention provides a prestressing element which can be set and which is included in a switching mechanism of the pneumatic switch. The prestressing element which can be set can preferably be used to preload an element of the switching mechanism. The prestressing element which can be set can advantageously be used to set a tripping threshold of the switching mechanism. This offers the advantage that it is possible to reduce a tripping sensitivity. This is possible in particular if the prestressing element is arranged such that it acts in the same effective direction as the diaphragm in operation under pressure loading.

The switching mechanism advantageously comprises a lever which can be loaded by the prestressing element and is operationally connected to the diaphragm. The operational connection is preferably produced via a pressure plate which, on the one hand, bears against the diaphragm and, on the other hand, acts on the lever. The prestressing element which can be set preferably loads the lever in a way that it is possible in this way to support or encumber a throwing of the lever tripped by pressure on the diaphragm so that it is possible to set a tripping threshold or a threshold for tripping the switching mechanism.

The switching mechanism advantageously has a switching element which is operationally connected to the lever. In this case, the lever and the switching element are preferably arranged such that the switching element is activated when the diaphragm is loaded above a tripping threshold. Such an arrangement can be achieved, for example, by having the lever function as a lever arm, the respective points of application for the pressure plate of the diaphragm and for the switching element being arranged at different distances from the fulcrum so as preferably to achieve a transmission which increases the force on the switching element by comparison with the force applied by the diaphragm. This offers the advantage of a further increase in the sensitivity of the pneumatic switch.

The lever and the switching element advantageously cooperate with a switching spring of the switching mechanism such that the switching mechanism is mechanically bistable. By way of example, this is possible by arranging the lever and the switching element such that tilting movements to both sides are possible, the respective tilting movements leading to states of lower stored energy in the switching spring. Various arrangements are possible and advantageous to this end, for example slot guides for the lever or the switching element or else an arrangement of the switching element and the lever in the form of a folded double pendulum. The switching element is advantageously rotatably supported on the lever at a fulcrum. In this case, it is also possible for a bearing contact of a blade of the switching element to be suffice as fulcrum on the lever. Again, the lever is advantageously supported rotatably. In this case, the lever is preferably rotatably supported at a fixed point or in a notch such that the lever and the switching element can kinematically form a double pendulum. The lever is advantageously aligned in opposition to the switching element and the fulcrum thereof on the lever. It is possible in this way to provide a mechanically bistable switching mechanism by a simple spring loading of the switching element.

Advantageous embodiments have a switching mechanism which during a switching operation effect a displacement of the switching element, preferably on a contact, of a contact surface or a contact blade in a fashion perpendicular to a switching movement direction. This means that the switching element is moved not only in a direction onto a contact or away from a contact, but also perpendicular to this direction. This is possible, for example, with the described lever and the switching element, which are supported like a folded double pendulum. Other kinematics can be used, slot guides constituting one alternative. The advantage is that ?? self cleaning of the contacts.

The switching spring advantageously presses the switching element against the fulcrum on the lever. A mechanically bistable system is preferably provided in this way.

The prestressing element advantageously comprises a spring which can be adjusted from outside a housing of the pneumatic switch. In this way, the threshold which can be set for the tripping threshold of the switching mechanism can be adjusted from outside the housing. The prestressing element advantageously comprises a rotating spring which can be adjusted from outside the housing of the pneumatic switch and whose end engages in the lever. A rotating spring offers the advantage that it has a lesser space requirement and can be set directly by a simple rotary movement. It is advantageous to arrange on the housing a scale which enables the possibility of repeatedly setting the rotating spring.

The rotating spring can expediently be set by a rotatable pin, it being possible to limit the angle of rotation of the pin by a stop which can be fixedly connected to the pin or the housing. It is preferred that firstly the pin is fixedly connected to the stop, for example by frictional or positive locking, the setting range of the rotating spring then being adjusted and the stop being fixedly connected to the housing after the adjustment has been performed such that the stop serves as path limiter for the pin. Advantageous embodiments of the invention are set up for this preferred procedure. This offers the advantage of the possibility of exact adjustment. The stop is preferably designed as a striker which initially rests on the pin and is or can be pressed into the housing after the adjustment has been performed such that it is positively or fixedly connected to the housing, the operational connection to the pin being reduced to a path limitation of the angle of twist of the pin.

The prestressing element preferably acts in the same effective direction as the diaphragm acts against the lever. This offers the advantage that the tripping sensitivity of the switching mechanism can be reduced.

The pneumatic switch preferably comprises a switching space in which a fixed break contact or a fixed make contact can be arranged. This offers the advantage that it is possible during production of the pneumatic switch to make a simple selection between two variants, specifically a switch open upon activation and a switch closed upon activation. The fixed break contact advantageously differs from the fixed make contact only by a longer connection pin which serves the purpose of guiding the contact out of the housing.

The switching element advantageously has a switching contact end which is arranged in the switching space. The switching contact is preferably at the opposite end of the pivot bearing of the switching element on the lever. In this case, the switching space is preferably not closed off from the remaining space in which the switching mechanism is held. The switching space offers the advantage that the fixed break contact or the fixed make contact can be arranged in the switching space.

The switching element is preferably of symmetrical design about at least one axis of symmetry. This offers the advantage that in the event of different installation of a fixed break contact or a fixed make contact it is necessary merely to install said contacts with a twist of 180° in order for them to function as make contact or as break contact.

A subject matter of the invention is also a kit having a pneumatic switch in an inventive embodiment or one of the preferred embodiments set forth above, and a fixed break contact or a fixed make contact. Such a kit offers the advantage that it can be used in a simple way to produce a pneumatic switch which is open upon activation or closed upon activation. This offers advantages in terms of construction costs.

A further independent subject matter of the invention is a method for the production of a pneumatic switch in one of the preferred embodiments set forth above, in which a selection is made as to whether the pneumatic switch is to be a switch open upon activation or closed upon activation, a fixed break contact or a fixed make contact being installed as a function of the selection. The installation position of the switching element is advantageously determined as a function of the selection. It is determined in this way that the switching element is installed in a first position if a fixed break contact is installed, and that the switching element is installed in a second position, preferably twisted by 180°, if a fixed make contact is installed. This approach enables two different switches to be produced in a simple way and cost effectively with the aid of one production method. Within the scope of a preferred production method, an adjustment of a rotating spring is preferably also undertaken with the aid of a stop in one of the abovedescribed possibilities.

DETAILED DESCRIPTION

Figure 1:
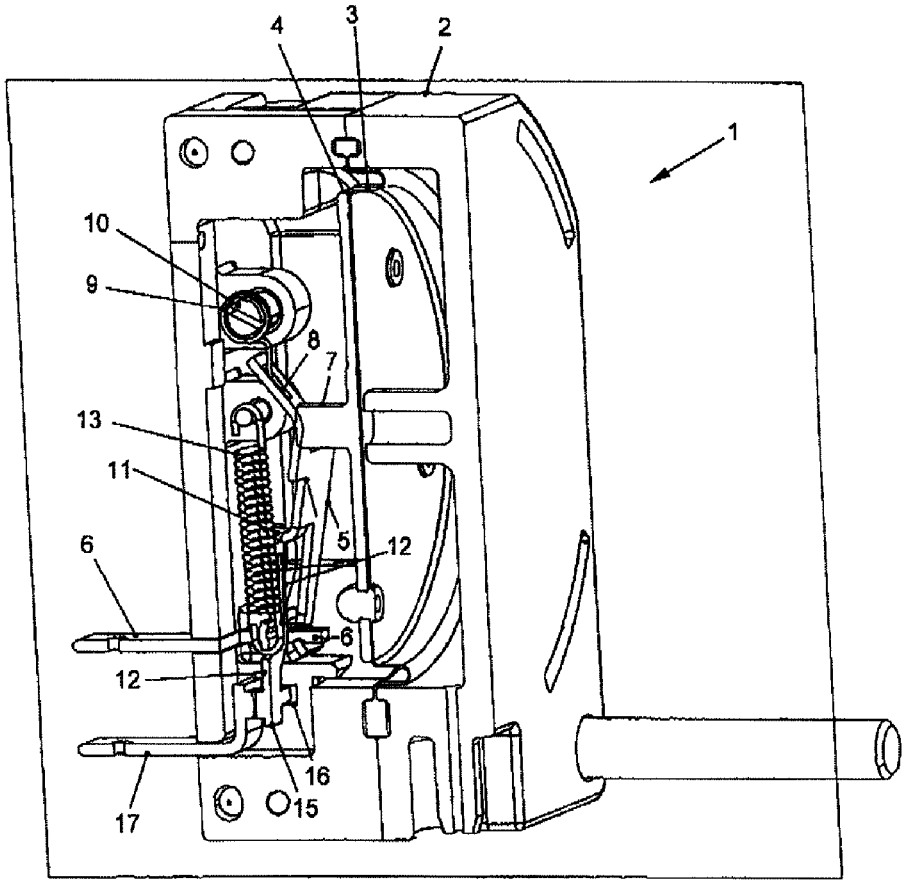
FIG. 1 shows a sectional schematic side view of an inventive pneumatic switch.

A pneumatic switch 1 is shown in FIG. 1 in a schematic sectional side view. The pneumatic switch 1 comprises a housing 2 which is assembled from a plurality of parts which hold the edge of a diaphragm 3 in a joint. On one side, the diaphragm 3 is arranged bordering a pressure space, a pressure plate 4 being arranged on the other side of the diaphragm 3. The pressure plate 4 acts on a lever 5. The lever 5 is hooked in a first fixed contact 6 at its end illustrated at the bottom of FIG. 1. To this end, the first fixed contact 6 has a notch in which the lever 5 is hooked.

The lever 5 bears against a pressure pin 7 of the pressure plate 4, the lever 5 further having at its upper end a slot 8 in which the end of a rotating spring 9 engages. In this way, the rotating spring 9 prestresses the lever 5 in a direction away from the pressure plate 4. The rotating spring 9 is arranged on a rotatable pin 10, it being possible to rotate the rotatable pin 10 from outside the housing 2 in order to set the prestressing force of the rotating spring 9. The prestressing force acting on the lever 5 can be set in this way. To this end, the rotatable pin 10 is guided up to the surface of the housing 2 of the pneumatic switch 1.

A switching element 12 rests like a blade on an abutment 11 of the lever 5. The switching element 12 is preloaded by a switching spring 13 which presses the switching element 12 upwards against the abutment 11. Since the abutment 11 is, moreover, fitted on an extension of the lever 5, the force acts on the lever 5 such that the lever is rotated to the right in the clockwise direction. The lever 5 is thereby pressed against the prestressing spring 9 and against the pressure plate 4 or the pressure pin 7.

When the diaphragm 3, and thus the pressure plate 4, are activated the lever 5 is now rotated counter to the clockwise direction about its fulcrum on the first fixed contact 6. In this process, the abutment 11 in FIG. 1 is displaced to the left. As soon as the abutment 11 is displaced sufficiently far to the left, the switching element 12 snaps over because of the spring loading by the switching spring 13 such that a defined switchover operation is achieved.

The switching operation is achieved by using the switching element 12 to move a switching contact end 15 of the switching element 12. The switching contact end 15 is additionally guided in this process in a guide 16. In this case, the switching contact end 15 moves away from a fixed break contact 17 such that an electric circuit is interrupted by the pneumatic switch 1. That is to say, the fixed break contact 17 is no longer connected in a conducting fashion to the first fixed contact 6 as soon as the switching contact end 15 moves to the right in FIG. 1.

The invention offers the advantages of a defined switching point by means of a bistable mechanical system, a lower sensitivity, which can, moreover, be set, owing to the prestressing rotating spring and, moreover, the advantage that the pneumatic switch can also easily be assembled in another configuration, as is explained below in conjunction with FIG. 2.

Figure 2:
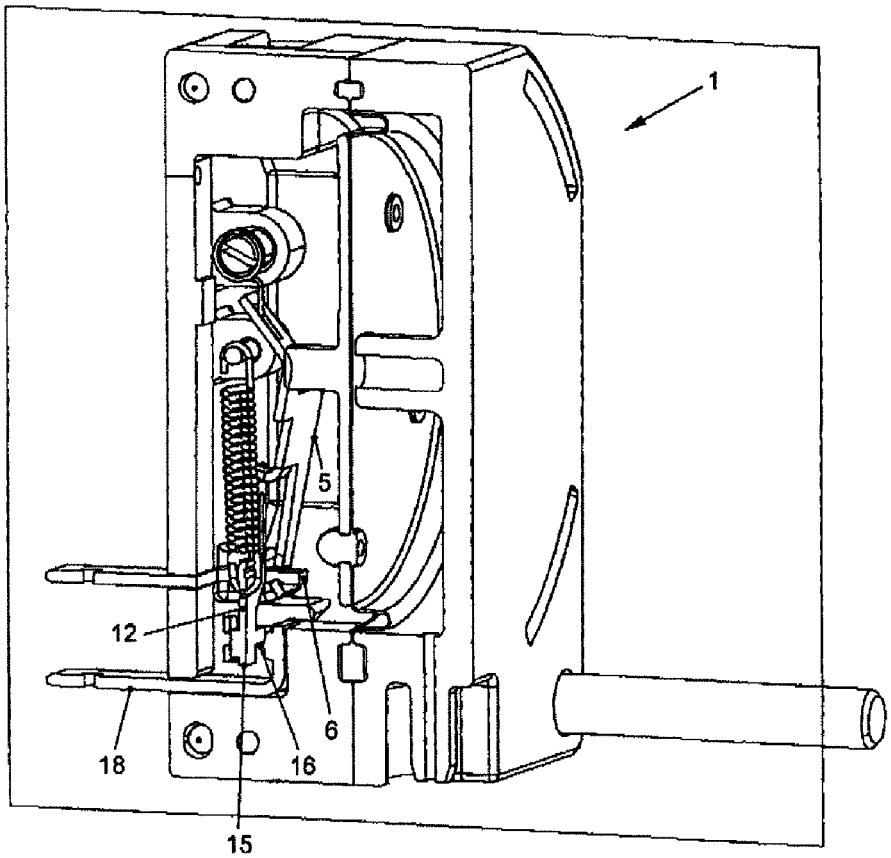
FIG. 2 shows a sectional schematic side view of a further pneumatic switch.
Figure 3:
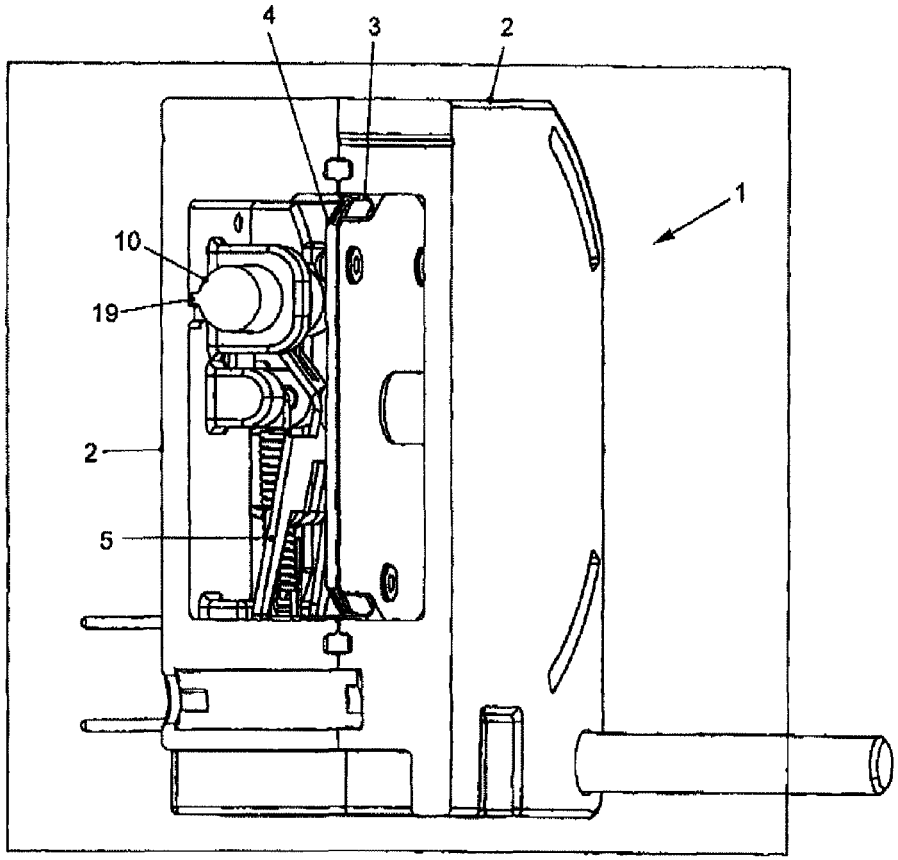
FIG. 3 shows in schematically a further sectional view of the pneumatic switch of FIG. 1.

It should be remarked in general that identical reference numerals are used in FIGS. 1 to 5 for identical or similar parts, not all parts being examined in detail once again in the description of FIGS. 2 to 5, but reference being made to the description of FIG. 1. Also to be remarked is that FIGS. 1, 2 and 3 represent sectional drawings, the lever and the switching element, in particular, being shown in section. The sectional plane in this case lies slightly to the side of the plane of symmetry of the pneumatic switch, it thereby being clear that, taking account of the slightly asymmetric sectional plane, the remaining part of the pneumatic switch substantially corresponds to the part illustrated.

FIG. 2 illustrates an inventive pneumatic switch 1 which differs from the pneumatic switch illustrated in FIG. 1 particularly in that it is not a fixed break contact 17, but a fixed make contact 18 which is installed. To this end, the switching element 12 is, moreover, installed in a fashion rotated by 180° about the vertical axis such that the contact is now closed if the switching contact end is arranged on that side of the switching space which is on the right in the figure. The switching element 12 for this purpose preferably has a shape like a bar of a cross being guided in a guide 16 at the switching contact end 15. A symmetrical guide for an opposite bar of the cross of the switching element 12 is not illustrated.

FIG. 3 shows the pneumatic switch of FIG. 1 in schematically in a further sectional view, the sectional plane of FIG. 3 being displaced in parallel by comparison with the sectional plane of FIG. 1. FIG. 3 shows the rotatable pin more precisely, a stop 19 of the pin 10 being shown. The stop 19 cooperates with a stopper which is designed in an integral fashion with the housing 2. It is possible in this way to provide a defined setting range for the prestressing element or the rotating spring 9.

Figure 4:
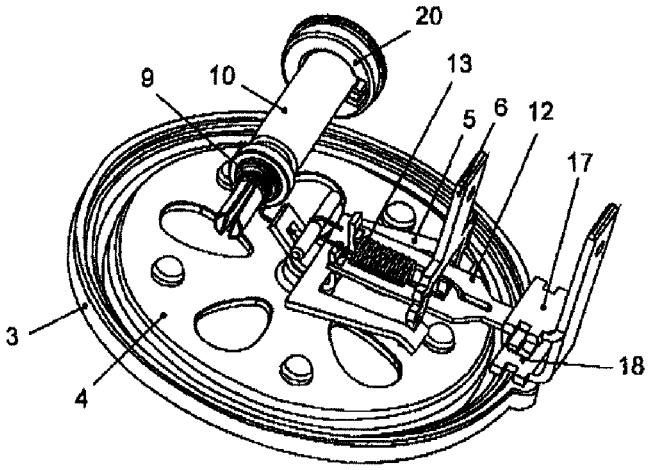
FIG. 4 shows a partial, perspective view of a further preferred embodiment of a stop which is used together with the pneumatic switches of FIG. 1 or 2.

FIG. 4 shows a partial, perspective view of a further preferred embodiment of a stop 20 which is used together with the pneumatic switches 1 of FIG. 1 or 2. For the sake of clarity, some parts are omitted in FIG. 4, nor are all parts provided with reference numerals. The angle of rotation of the pin 10 can be limited by the stop 20, which can optionally be fixedly connected to the pin 10 or to the housing 2. Firstly, the pin 10 is fixedly connected to the stop 20 in a positively locking fashion, an adjustment of a setting range of the rotating spring 9 then being undertaken, and after the adjustment has been performed the stop 20 is fixedly connected to the housing 2 such that the stop 20 serves as path limiter for the pin 10. The stop 20 is designed as a stop ring which firstly rests on the pin 10 and, after the adjustment has been performed, is pressed into the housing 2 such that it is connected to the housing 2 in a positively locking or fixed fashion.

Also shown in FIG. 4 is how the switching mechanism forms together with the lever 5 and the contact element 12 a kinematic which effects a displacement of the switching element 12 on a contact surface in the event of a switching operation. The fixed break contact 17 and the fixed make contact 18, both of which are illustrated in FIG. 4, respectively also have a contact blade (see FIGS. 1 and 2) which supports self-cleaning by the movement described. The movement perpendicular to the switching movement is achieved by the offset on the lever 5 and by the use of the lever 5 together with the contact element 12.

Figure 5:
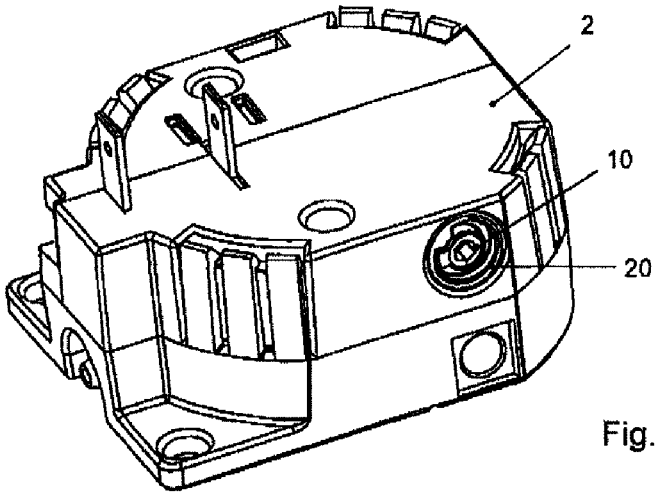
FIG. 5 shows a schematic perspective view of a switch having the stop of FIG. 4.

FIG. 5 shows a schematic perspective view of a switch having the stop 20 of FIG. 4. The path limitation of the angle of rotation of the pin 10 is shown after the adjustment has been performed and the stop 20 has been pressed into the housing 2.

The invention claimed is:

1. Pneumatic switch comprising a diaphragm and a switching mechanism operationally connected to the diaphragm, the switching mechanism comprises a prestressing means for setting the sensitivity of the switching mechanism, wherein the prestressing means comprises a lever operatively connected to the diaphragm, the lever is provided with a slot, an end of a spring engaged is in the slot and a rotatable pin is attached to the spring, wherein rotation of the pin adjusts the tension of the spring and prestresses the lever setting the sensitivity of the switching mechanism, wherein the spring comprises a rotating spring which is designed to be adjusted from outside a housing of the pneumatic switch by rotation of the rotatable pin.

2. Pneumatic switch according to claim 1, wherein the switching mechanism comprises a switching element which is operationally connected to the lever.

3. Pneumatic switch according to claim 2, wherein the lever and the switching element cooperate with a switching spring of the switching mechanism such that the switching mechanism is mechanically bistable.

4. Pneumatic switch according to claim 3, wherein the switching element is rotatably supported on the lever at a fulcrum.

5. Pneumatic switch according to claim 4, wherein the switching element is pressed against the fulcrum by the switching spring.

6. Pneumatic switch according to claim 1, wherein an angle of rotation of the pin is limited by a stop which is operationally connected to the pin or the housing.

7. Pneumatic switch according to claim 1, wherein the prestressing element acts in an effective direction the same as the diaphragm acts against the lever.

8. Pneumatic switch according to claim 1, wherein a switching space is provided in which a fixed break contact or a fixed make contact is arranged.

9. Pneumatic switch according to claim 8, wherein a switching element has a switching contact end which is arranged in the switching space.

* * * * *